US006080086A

United States Patent [19]

Maresh et al.

[11] Patent Number: 6,080,086

[45] Date of Patent: Jun. 27, 2000

[54] ELLIPTICAL MOTION EXERCISE METHODS AND APPARATUS

[76] Inventors: Joseph D. Maresh, P.O. Box 645, West Linn, Oreg. 97068-0645; Kenneth W. Stearns, P.O. Box 55912, Houston, Tex. 77055

[21] Appl. No.: 09/111,221

[22] Filed: Jul. 7, 1998

Related U.S. Application Data

[63] Continuation-in-part of application No. 08/818,248, Mar. 14, 1997, Pat. No. 5,792,026

[60] Provisional application No. 60/051,825, Jul. 7, 1997.

[51] Int. Cl.[7] ..... A63B 22/00

[52] U.S. Cl. ..... 482/57; 482/51

[58] Field of Search ..... 482/51–53, 57, 482/70, 71, 79, 80, 148, 62

[56] References Cited

U.S. PATENT DOCUMENTS

| | | | |
|---|---|---|---|
| 4,185,622 | 1/1980 | Swenson | 128/25 B |
| 4,786,050 | 11/1988 | Geschwender | 272/73 |
| 5,186,697 | 2/1993 | Rennex | 482/52 |
| 5,242,343 | 9/1993 | Miller | 482/57 |
| 5,279,529 | 1/1994 | Eschenbach | 482/57 |
| 5,290,212 | 3/1994 | Metcalf | 482/62 |
| 5,295,928 | 3/1994 | Rennex | 482/52 |
| 5,352,169 | 10/1994 | Eschenbach | 482/57 |
| 5,383,829 | 1/1995 | Miller | 482/57 |
| 5,397,286 | 3/1995 | Chang | 482/62 |
| 5,423,729 | 6/1995 | Eschenbach | 482/70 |
| 5,453,066 | 9/1995 | Richter, Jr. | 482/57 |
| 5,518,473 | 5/1996 | Miller | 482/57 |
| 5,529,554 | 6/1996 | Eschenbach | 482/57 |
| 5,529,555 | 6/1996 | Rodgers, Jr. | 482/57 |
| 5,540,637 | 7/1996 | Rodgers, Jr. | 482/51 |
| 5,549,526 | 8/1996 | Rodgers, Jr. | 482/57 |
| 5,562,574 | 10/1996 | Miller | 482/51 |
| 5,573,480 | 11/1996 | Rodgers, Jr. | 482/57 |
| 5,577,985 | 11/1996 | Miller | 482/51 |
| 5,593,371 | 1/1997 | Rodgers, Jr. | 482/51 |
| 5,637,058 | 6/1997 | Rodgers, Jr. | 482/51 |
| 5,685,804 | 11/1997 | Whan-Tong et al. | 482/51 |
| 5,759,136 | 6/1998 | Chen | 482/57 |
| 5,762,588 | 6/1998 | Chen | 482/57 |
| 5,779,598 | 7/1998 | Lee | 482/57 |
| 5,779,599 | 7/1998 | Chen | 482/57 |

*Primary Examiner*—Stephen R. Crow

[57] ABSTRACT

An exercise apparatus links rotation of a crank to generally elliptical motion of a foot supporting member. In particular, both a foot supporting linkage and a drawbar linkage are movably connected between a rocker link and the crank in such a manner that the foot supporting member is constrained to move through an elliptical path of motion. The configuration of the elliptical path may be selectively altered by adjusting the drawbar linkage relative to the rocker link.

21 Claims, 6 Drawing Sheets

ELLIPTICAL MOTION EXERCISE METHODS AND APPARATUS

CROSS-REFERENCE TO RELATED APPLICATIONS

This application is a continuation-in-part application of U.S. patent application Ser. No. 08/818,248, filed on Mar. 14, 1997 (and issued as U.S. Pat. No. 5,792,026 on Aug. 11, 1998), and also discloses subject matter entitled to the filing date of U.S. Provisional Application Ser. No. 60/051,825, filed on Jul. 7, 1997.

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically converts a relatively simple motion, such as circular, into a relatively more complex motion, such as elliptical.

One shortcoming of these prior art elliptical motion exercise machines is that a direct relationship exists between the length of foot travel and the height of foot travel. Unfortunately, this fixed aspect ratio is contrary to real life activity and prohibits realistic adjustments to the stride length. In particular, a person should not be required to lift his legs higher and higher to take strides which are longer and longer. Therefore, a need exists for an improved elliptical motion exercise machine which facilitates adjustments to stride length without imposing an unnatural aspect ratio between stride length and stride height.

SUMMARY OF THE INVENTION

The present invention may be seen to provide a novel linkage assembly and corresponding exercise apparatus suitable for linking circular motion to relatively more complex, generally elliptical motion. Left and right cranks are mounted on a frame and rotatable about a common crank axis. Left and right rocker links are mounted on the frame and rotatable about a common rocker axis. Both left and right foot supporting linkages and left and right drawbar linkages are movably interconnected between respective cranks and respective rocker links. The drawbar linkages constrain the foot supporting linkages to move through generally elliptical paths of motion in response to rotation of the cranks, and the length of the elliptical paths may be adjusted without significantly changing the height of the elliptical paths.

In another respect, the present invention may be seen to provide a novel linkage assembly and corresponding exercise apparatus suitable for linking reciprocal motion to relatively more complex, generally elliptical motion. For example, left and right handles may be rotatably connected to the frame and linked to respective rocker links. As the foot supporting members move through their generally elliptical paths, the handles pivot back and forth relative to the frame.

In yet another respect, the present invention may be seen to provide a novel linkage assembly and corresponding exercise apparatus suitable for adjusting the angle of the generally elliptical paths of motion relative to a floor surface on which the apparatus rests. For example, the rocker links and/or the frame may be selectively locked in any of a plurality of positions relative to an underlying base and/or the floor surface, respectively. Many of the advantages of the present invention may become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
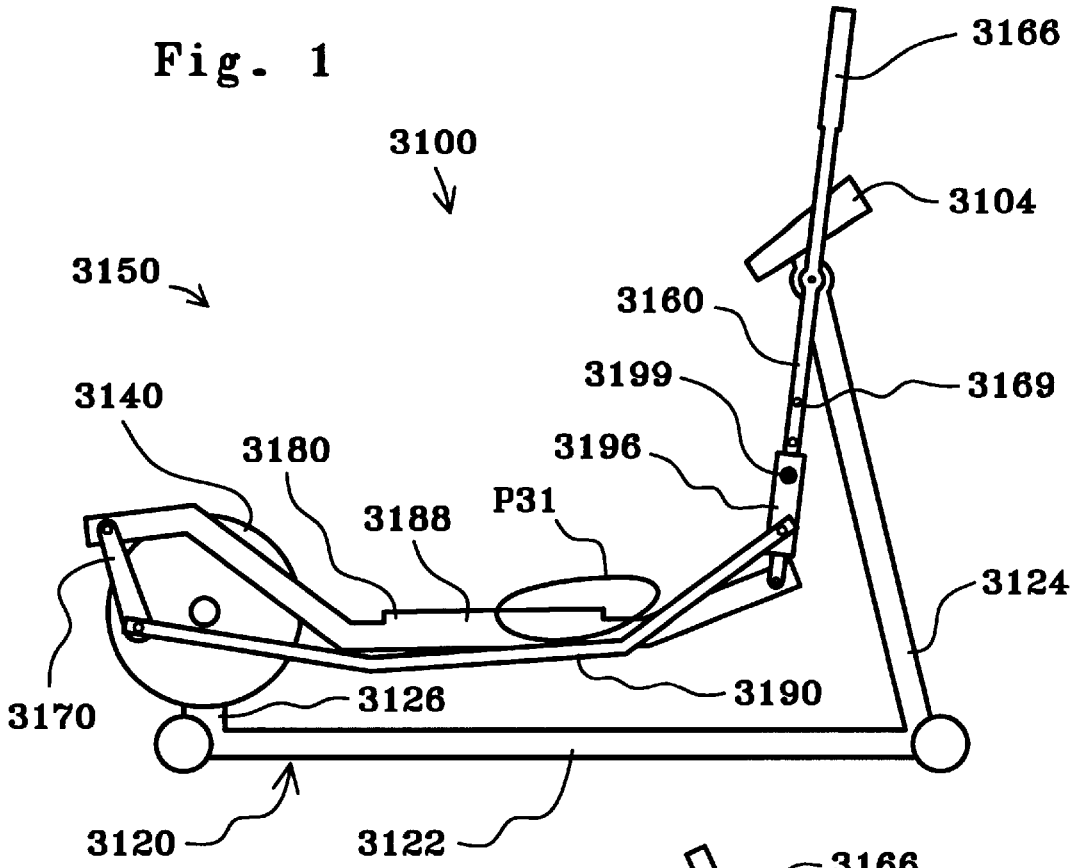
FIG. 1 is a side view of an exercise apparatus constructed according to the principles of the present invention.

The present invention provides various elliptical motion exercise machines which link rotation of left and right cranks to generally elliptical motion of respective left and right foot supports. The term "elliptical motion" is intended in a broad sense to describe a closed path of motion having a relatively longer first axis and a relatively shorter second axis (which extends perpendicular to the first axis).

The embodiments shown and/or described herein are generally symmetrical about a vertical plane extending lengthwise through a floor-engaging base (perpendicular to transverse ends thereof), the primary exception being the relative orientation of certain parts of the linkage assembly on opposite sides of the plane of symmetry. In general, the "right-hand" components are one hundred and eighty degrees out of phase relative to the "left-hand" components. However, like reference numerals are used to designate both the "right-hand" and "left-hand" parts, and when reference is made to one or more parts on only one side of an apparatus, it is to be understood that corresponding part(s) are disposed on the opposite side of the apparatus. The portions of the frame which are intersected by the plane of symmetry exist individually and thus, do not have any "opposite side" counterparts. Also, to the extent that reference is made to forward or rearward portions of an apparatus, it is to be understood that the linkage assembly is movable in either of two opposite directions for exercise purposes.

A first exercise apparatus constructed according to the principles of the present invention is designated as 3100 in FIGS. 1–4. The apparatus 3100 generally includes a frame 3120 and a linkage assembly 3150 movably mounted on the frame 3120. Generally speaking, the linkage assembly 3150 moves relative to the frame 3120 in a manner that links rotation of a flywheel 3140 to generally elliptical motion of a force receiving member 3180.

The frame 3120 includes a base 3122, a forward stanchion 3124, and a rearward stanchion 3126. The base 3122 may be described as generally I-shaped and is designed to rest upon a generally horizontal floor surface. The forward stanchion 3124 extends generally perpendicularly upward from the base 3122 proximate the forward end thereof. The rearward stanchion 3126 extends generally perpendicularly upward from the base 3122 proximate the rearward end thereof. A user interface 3104 is mounted on top of the forward stanchion 3124. The interface 3104 displays information regarding exercise performance and/or facilitates adjustment of the exercise motion.

A bearing assembly is mounted on the rearward stanchion 3126. An axle is inserted through a laterally extending hole in the bearing assembly to support a pair of flywheels 3140 in a manner known in the art. Those skilled in the art will recognize that the flywheels 3140 could be replaced by some other rotating member(s) which may or may not, in turn, be connected to one or more flywheels. In any event, these rotating members 3140 rotate about a common crank axis which is designated as A31 in FIG. 2.

A radially displaced post is rigidly secured to each flywheel 3140 by means known in the art. Each post is secured to the flywheel 3140 at a point radially displaced from the flywheel axis A31, and thus, each post rotates at a fixed radius about the flywheel axis A31. In other words, each post and respective flywheel 3140 cooperate to define a crank having a crank radius.

A floating crank or crank link 3170 is rotatably mounted on each flywheel post. The crank link 3170 on the right side of the apparatus 3100 rotates about a link axis which is designated as B31 in FIG. 2. The crank link on the left side of the apparatus 3100 rotates about a link axis which is diametrically opposed from the link axis B31 (relative to the crank axis A31). An opposite, distal end of each crank link 3170 is rotatably connected to a rearward end of a respective foot supporting member 3180. An intermediate portion of each foot supporting member 3180 is sized and configured to support a person's foot. An opposite, forward end of each foot supporting member 3180 is rotatably connected to a lower end of a respective rocker link 3160, thereby defining a respective axis D31. Each foot supporting member 3180 and respective crank link 3170 may be collectively described as a foot supporting linkage or means which is connected between a respective crank 3140 and a respective rocker link 3160.

A drawbar link 3190 is also rotatably mounted on each flywheel post and similarly rotates about a respective link axis. An opposite, forward end of each drawbar link 3190 is rotatably connected to a respective sleeve or member 3196 which in turn, is mounted on a respective rocker link 3160. As a result, each drawbar link 3190 rotates about a respective axis E31 relative to a respective rocker link 3160. Each sleeve 3196 is selectively slideable along a respective rocker link 3160 and selectively secured in place by means of a fastener or pin 3199 which inserts through a hole in a respective sleeve 3196 and through any of several holes 3169 in a respective rocker link 3160. A relatively higher portion of each rocker link 3160 is connected to the forward stanchion 3124 and rotates relative thereto about a common pivot axis which is designated as C31 in FIG. 2. Each drawbar link 3190 and respective sleeve 3196 may be collectively described as a drawbar linkage or constraining means which is interconnected between a respective crank 3140 and a respective rocker link 3160.

Figure 2:
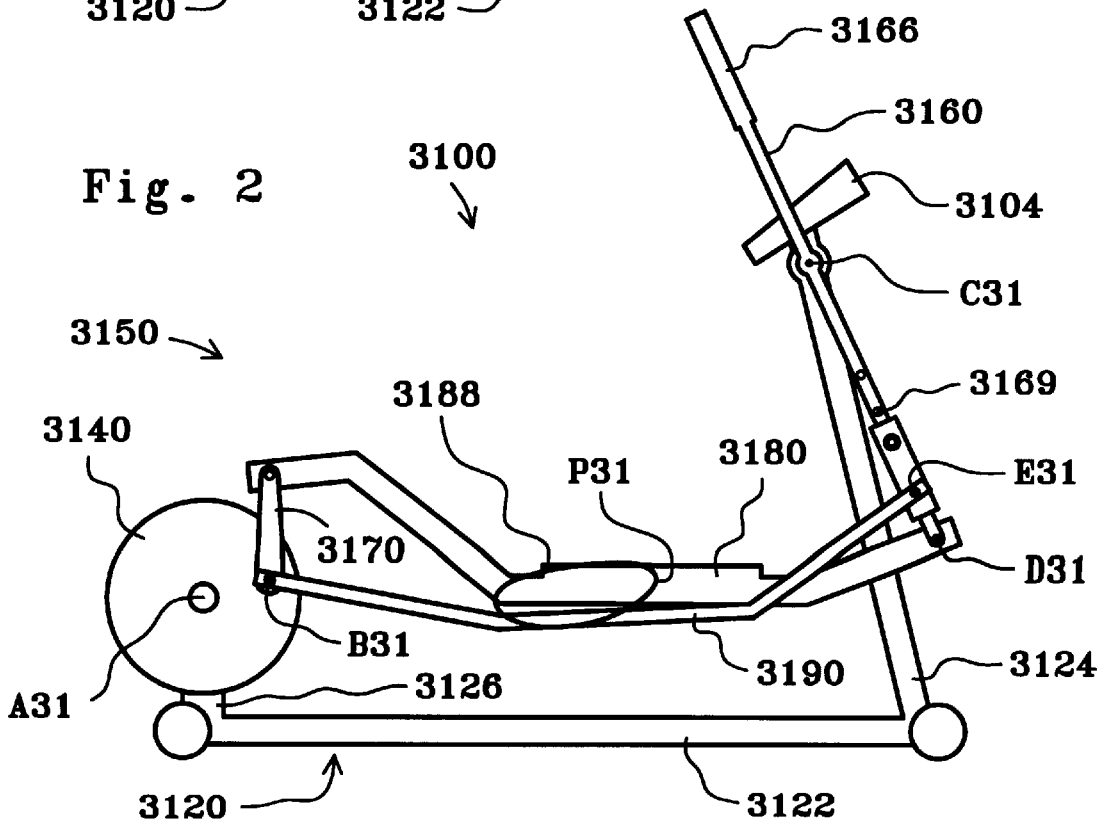
FIG. 2 is a side view of the exercise apparatus of FIG. 1, with the linkage assembly approximately one hundred and eighty degrees out of phase relative to the exercise apparatus of FIG. 1.
Figure 3:
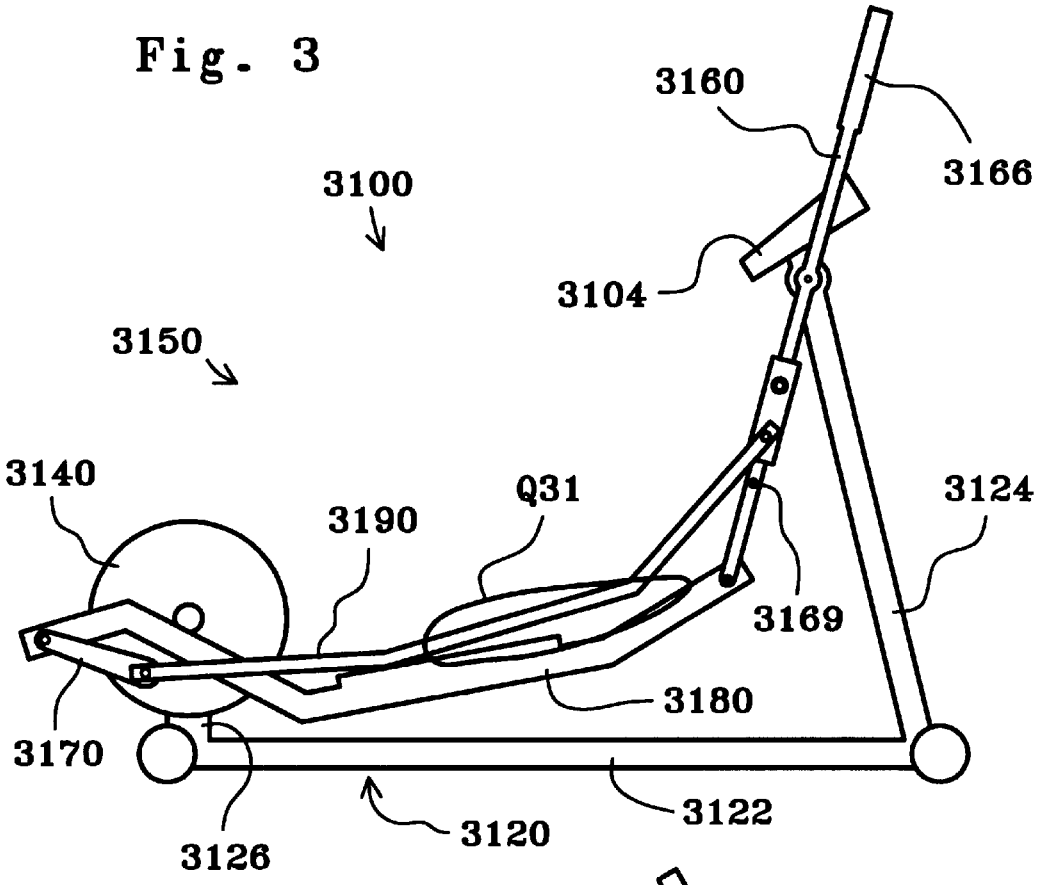
FIG. 3 is a side view of the exercise apparatus of FIG. 1, with the linkage assembly adjusted to provide a relatively longer exercise stroke.
Figure 4:
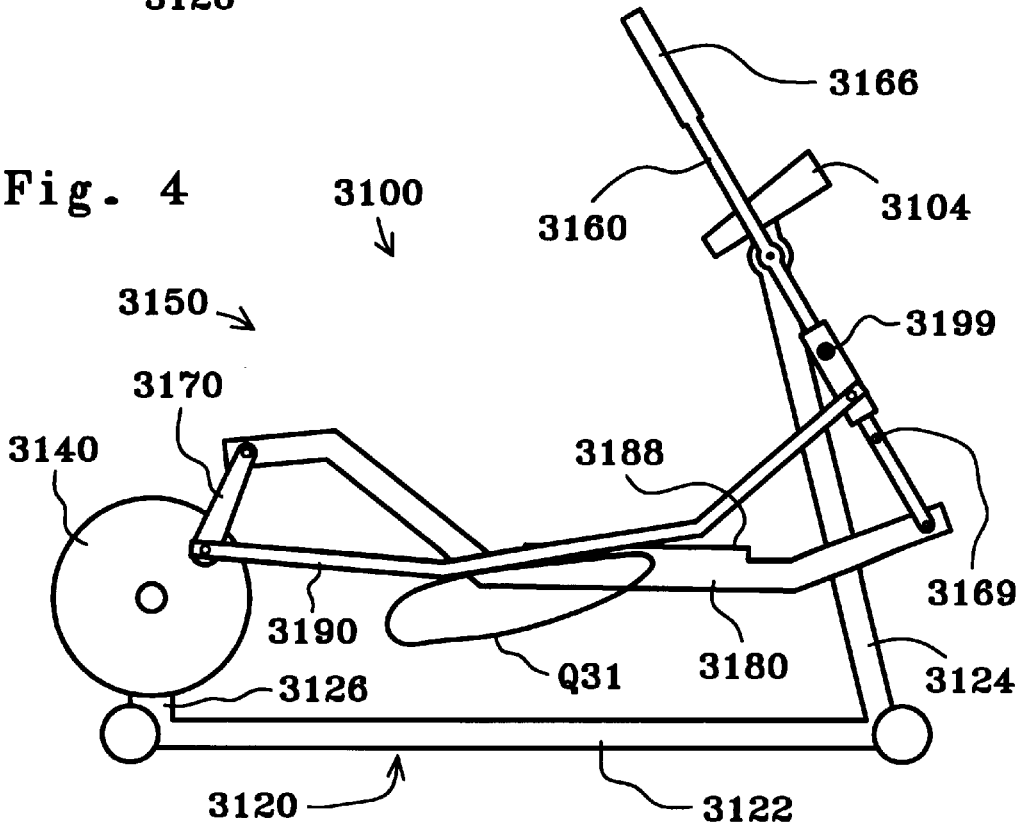
FIG. 4 is a side view of the exercise apparatus of FIG. 3, with the linkage assembly approximately one hundred and eighty degrees out of phase relative to the exercise apparatus of FIG. 3.

When the apparatus 3100 is configured as shown in FIGS. 1–2, rotation of the flywheels 3160 causes the foot platforms 3188 to move through elliptical paths designated as P31. When the apparatus 3100 is configured as shown in FIGS. 3–4, rotation of the flywheels 3160 causes the foot platforms 3188 to move through elliptical paths designated as Q31. The horizontal displacement of the foot platforms 3188 is controlled or limited by the pivot range of the axis D31 about the pivot axis C31. The pivot range of the axis D31 is a function of the relative locations of the axes D31 and E31. In the configuration shown in FIGS. 3–4, the axis E31 is relatively closer to the pivot axis C31, and a relatively greater disparity exists between the pivot radii of the axes D31 and E31.

A second exercise apparatus constructed according to the principles of the present invention is designated as 3200 in FIGS. 5–8. The apparatus 3200 is similar in many respects to the first embodiment 3100, and the following description will focus primarily on the distinctions. Like the previous embodiment 3100, the apparatus 3200 generally includes a frame 3120 and a linkage assembly 3250 movably mounted on the frame 3120 and operable to link rotation of a flywheel 3140 to generally elliptical motion of a force receiving member 3280.

A radially displaced post is rigidly secured to each flywheel 3140 by means known in the art. Each post is secured to the flywheel 3140 at a point radially displaced from the flywheel axis A32, and thus, each post rotates at a fixed radius about the axis A32. In other words, each post and respective flywheel 3140 cooperate to define a crank having a crank radius.

A floating crank or crank link 3270 is rotatably mounted on each flywheel post. The crank link 3270 on the right side of the apparatus 3200 rotates about a link axis which is designated as B32 in FIG. 6. The crank link on the left side of the apparatus 3200 rotates about a link axis which is diametrically opposed from the link axis B32 (relative to the flywheel axis A32). An opposite, distal end of each crank link 3270 is rotatably connected to a rearward end of a respective foot supporting member 3280. An intermediate portion 3288 of each foot supporting member 3280 is sized and configured to support a person's foot and may be described as a foot platform 3288. An opposite, forward end of each foot supporting member 3280 is rotatably connected to a lower end of a respective rocker link 3160, thereby defining a respective axis D32. Each foot supporting member 3280 and respective crank link 3270 may be collectively described as a foot supporting linkage or means which is connected between a respective crank 3140 and a respective rocker link 3160.

A first drawbar link 3291 has a first end rotatably connected to an intermediate portion of a respective crank link 3270. An opposite, forward end of each drawbar link 3291 is rotatably connected to a rearward end of a respective second drawbar link 3292. Each resulting axis F32 is constrained to move in reciprocal fashion relative to a respective foot platform 3288. In particular, the pin joint for each axis F32 is guided by a respective linear slot formed in a respective foot platform 3288. An opposite, forward end of each drawbar link 3293 is rotatably connected to a respective sleeve or member 3196, thereby defining a respective axis E32. Each drawbar link combination and respective crank link 3270 may be collectively described as a drawbar linkage or constraining means which is interconnected between a respective crank 3140 and a respective rocker link 3160.

Figure 5:
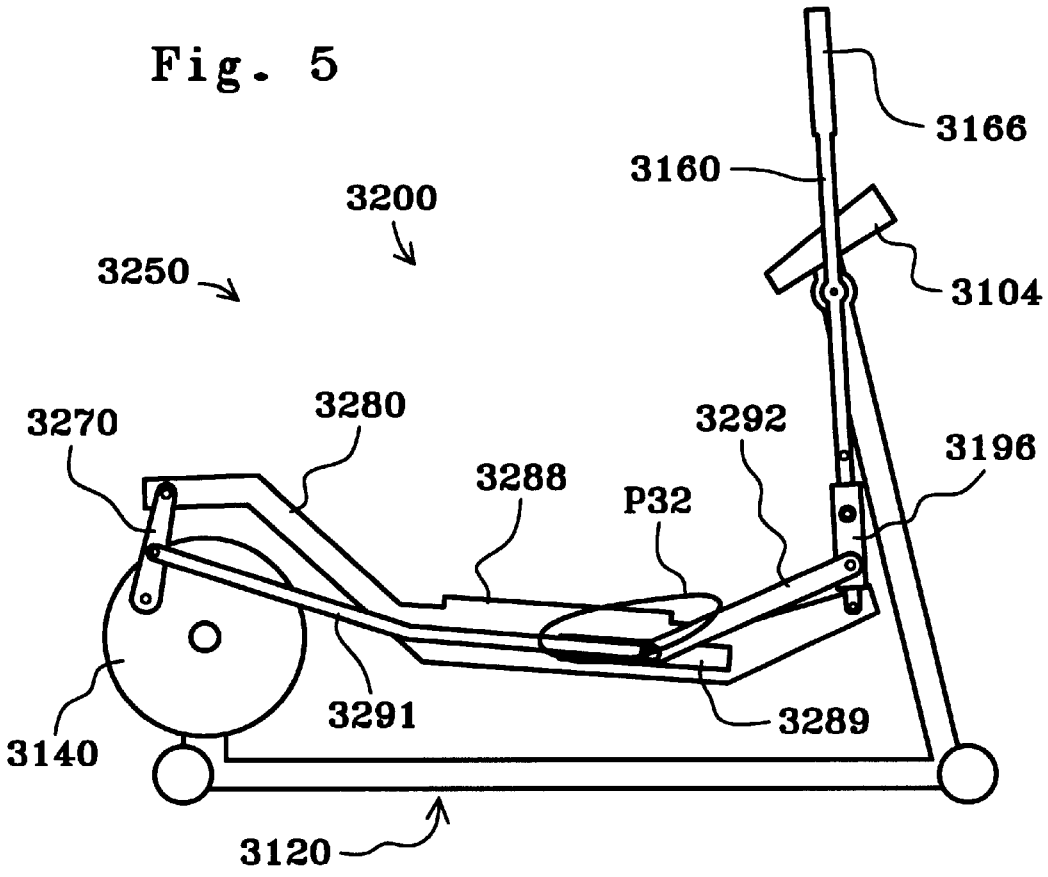
FIG. 5 is a side view of another exercise apparatus constructed according to the principles of the present invention.
Figure 6:
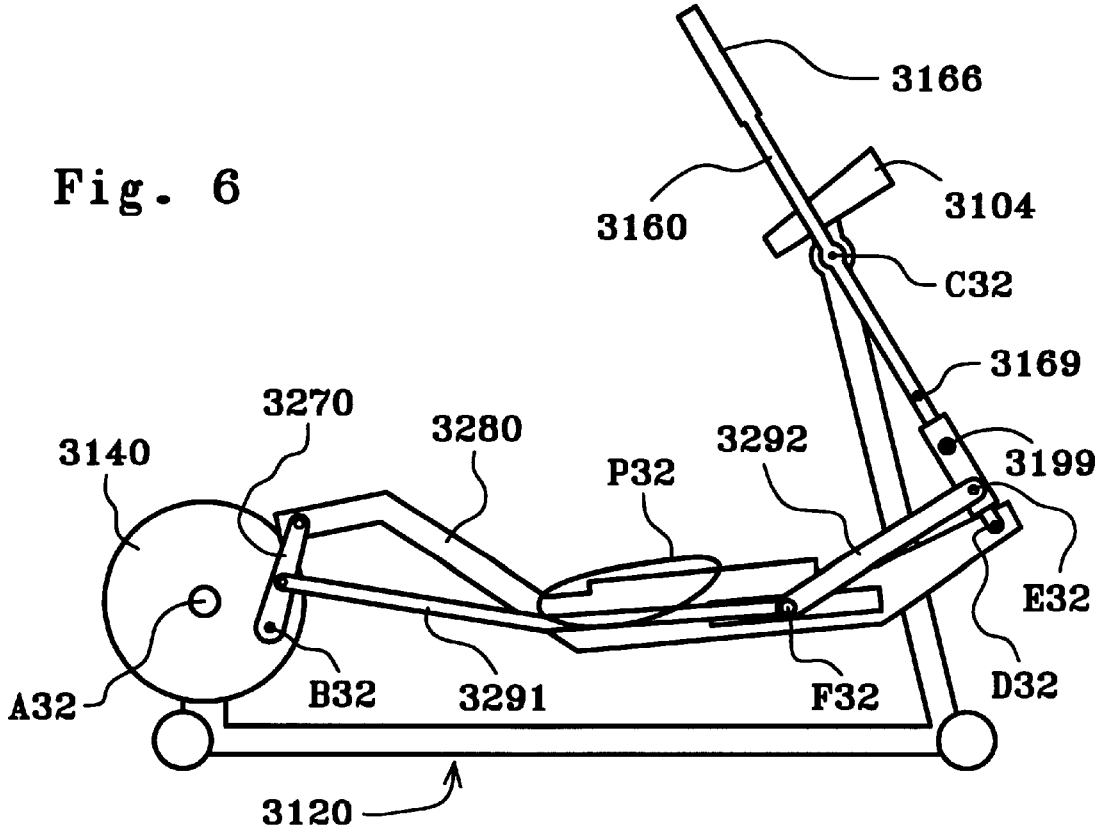
FIG. 6 is a side view of the exercise apparatus of FIG. 5, with the linkage assembly approximately one hundred and eighty degrees out of phase relative to the exercise apparatus of FIG. 5.
Figure 7:
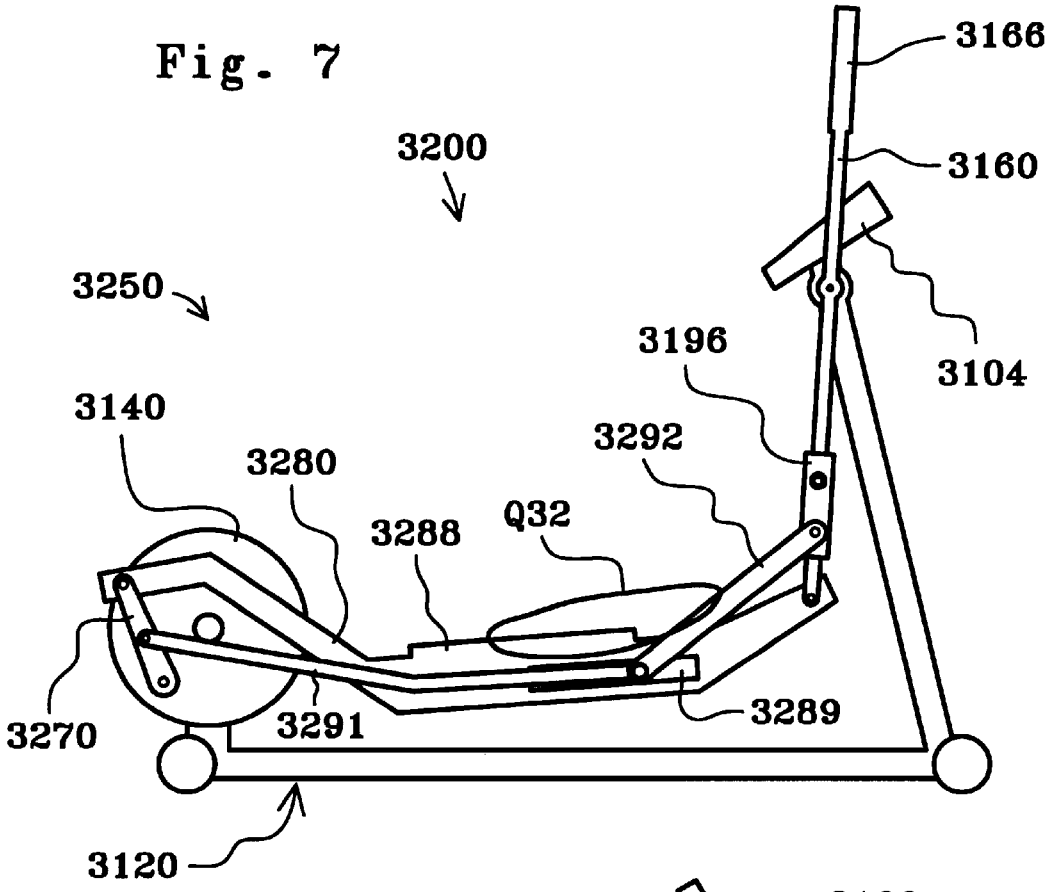
FIG. 7 is a side view of the exercise apparatus of FIG. 5, with the linkage assembly adjusted to provide a relatively longer exercise stroke.
Figure 8:
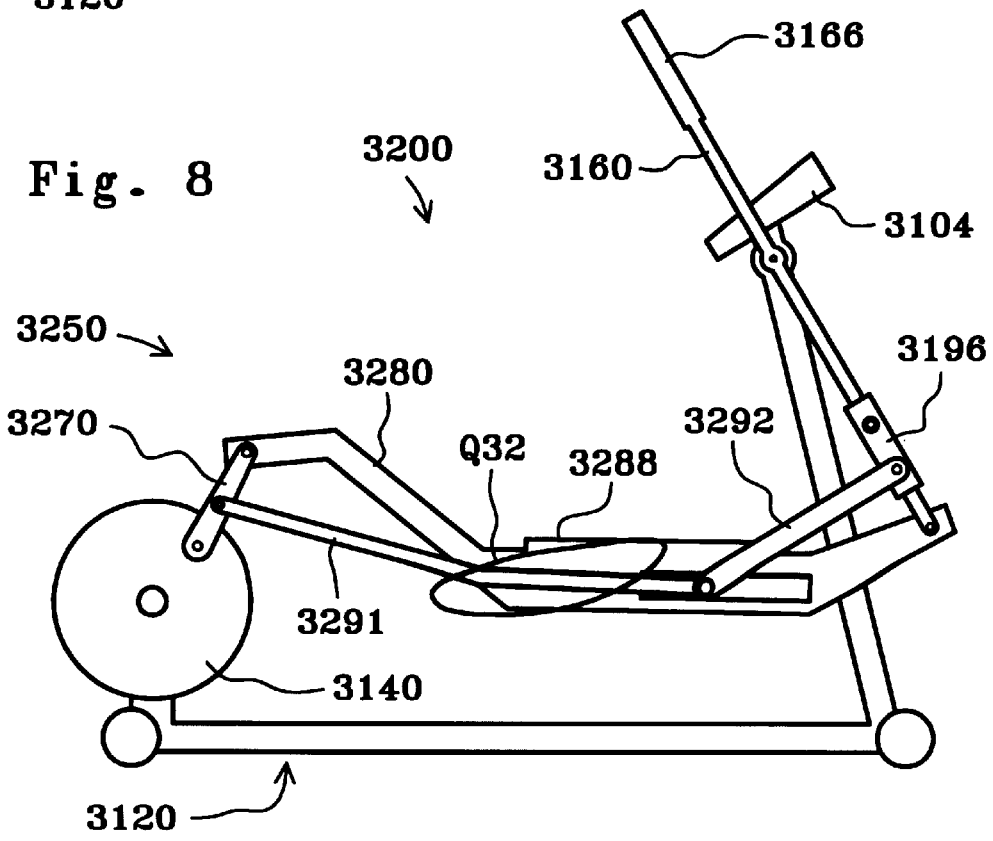
FIG. 8 is a side view of the exercise apparatus of FIG. 7, with the linkage assembly approximately one hundred and eighty degrees out of phase relative to the exercise apparatus of FIG. 7.

When the apparatus 3200 is configured as shown in FIGS. 5–6, rotation of the flywheels 3160 causes the foot platforms 3288 to move through elliptical paths designated as P32. When the apparatus 3200 is configured as shown in FIGS. 7–8, rotation of the flywheels 3160 causes the foot platforms 3288 to move through elliptical paths designated as Q32. As on the previous embodiment 3100, the horizontal displacement of the foot platforms 3288 is controlled or limited by the pivot range of the axis D32 about the pivot axis C32, and adjustments to the pivot range are effected by moving the sleeves 3196 along respective rocker links 3160.

A third exercise apparatus constructed according to the principles of the present invention is designated as 3300 in FIGS. 9–12. The apparatus 3300 is similar in many respects to the second embodiment 3200, and the following description will focus primarily on the distinctions. Like the previous embodiments 3100 and 3200, the apparatus 3300 generally includes a frame 3120 and a linkage assembly 3350 movably mounted on the frame 3120 and operable to link rotation of a flywheel 3140 to generally elliptical motion of a force receiving member 3180.

A floating crank or crank link 3270 is rotatably mounted on each flywheel 3140. Each crank link 3270 rotates about a respective link axis B33 which in turn, rotates about a common flywheel or crank axis A33. An opposite, distal end of each crank link 3270 is rotatably connected to a rearward end of a respective foot supporting member 3180 (having an intermediate portion 3188 sized and configured to support a person's foot). An opposite, forward end of each foot supporting member 3280 is rotatably connected to a lower end of a respective rocker link 3360, thereby defining a respective axis D33.

An upper portion of each rocker link 3360 is mounted on the forward stanchion 3124 and rotates about a common pivot axis C33 relative thereto. An upper distal end 3366 of each rocker link 3360 is sized and configured for grasping by a person standing on the foot platforms 3188. Each foot supporting member 3180 and respective crank link 3270 may be collectively described as a foot supporting linkage or means which is connected between a respective crank 3140 and a respective rocker link 3360.

A drawbar link 3390 has a first end rotatably connected to an intermediate portion of a respective crank link 3270. An opposite, forward end of each drawbar link 3390 is rotatably connected to a proximate end of a respective lever or member 3393, thereby defining a respective axis E33. An opposite end of each lever 3393 is rotatably connected to a respective rocker link 3360 intermediate the axes C33 and D33, thereby defining an axis G33. An actuator 3395 is rotatably interconnected between an intermediate portion of each lever 3393 and a portion of a respective rocker link 3360 disposed between the axes C33 and G33. Each drawbar link 3390 and respective crank link 3270 may be collectively described as a drawbar linkage or constraining means which is interconnected between a respective crank 3140 and a respective rocker link 3360.

Figure 9:
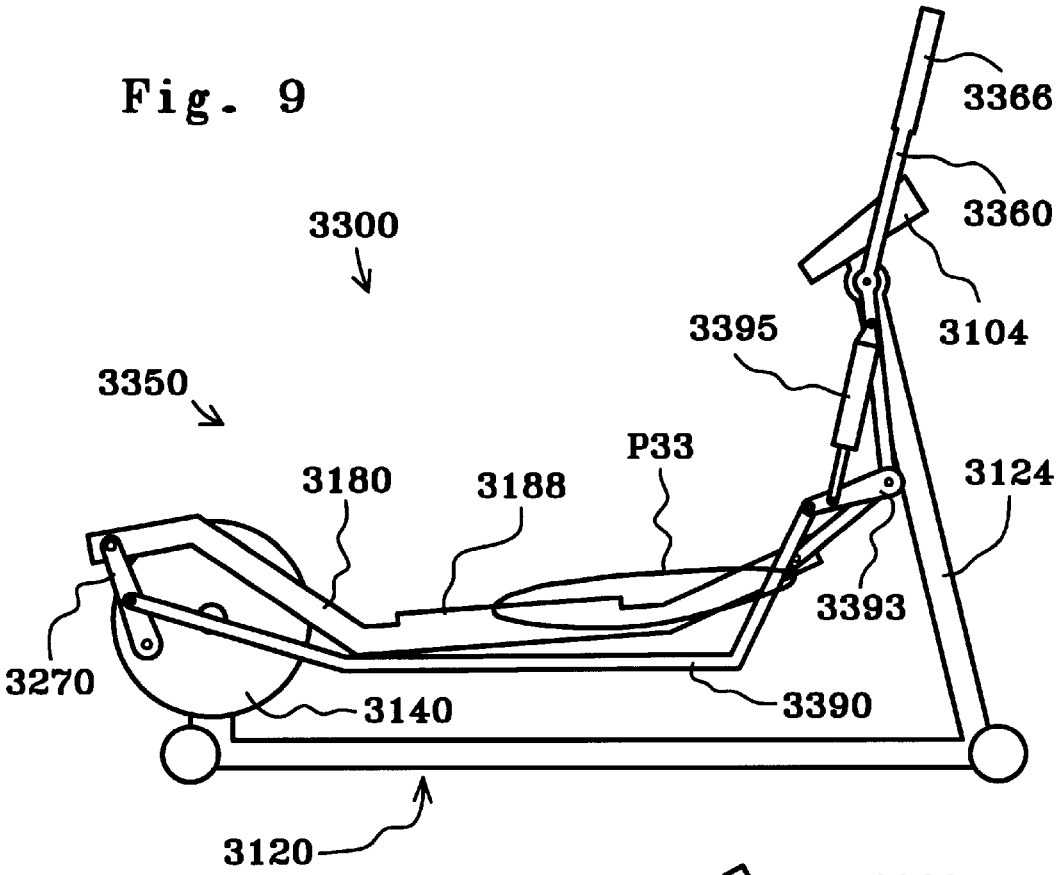
FIG. 9 is a side view of yet another exercise apparatus constructed according to the principles of the present invention.
Figure 10:
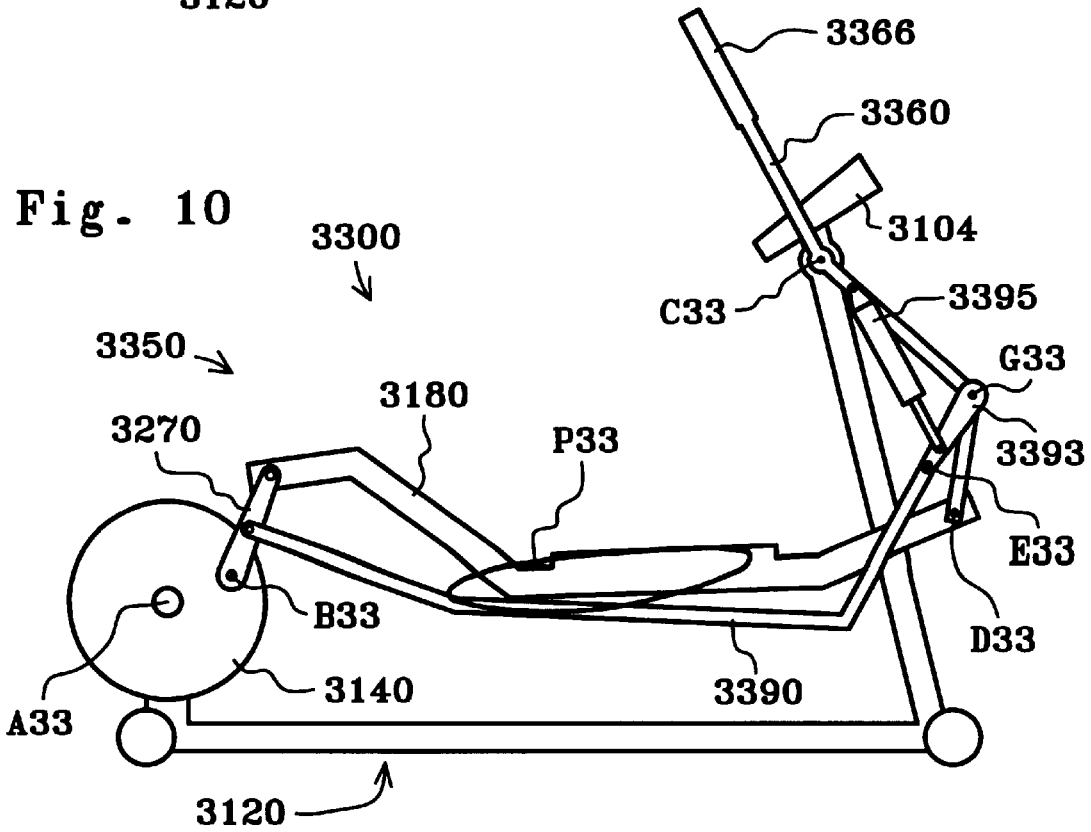
FIG. 10 is a side view of the exercise apparatus of FIG. 9, with the linkage assembly approximately one hundred and eighty degrees out of phase relative to the exercise apparatus of FIG. 9.
Figure 11:
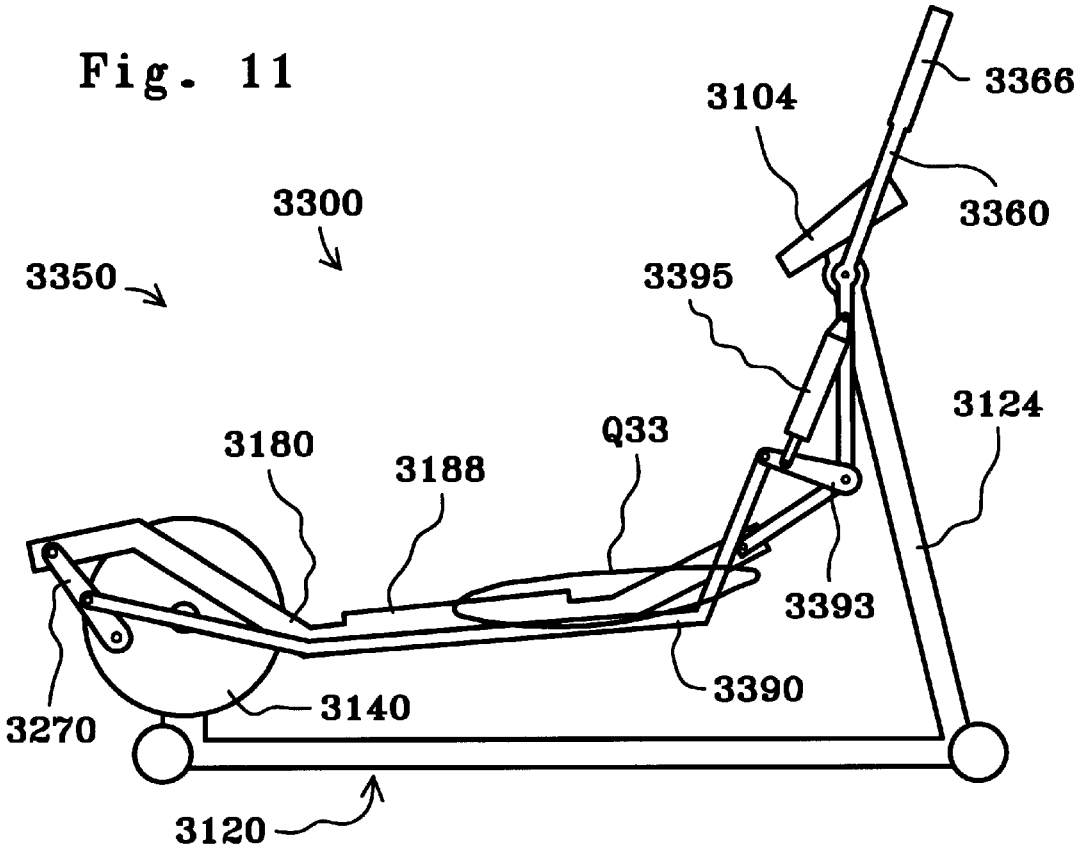
FIG. 11 is a side view of the exercise apparatus of FIG. 9, with the linkage assembly adjusted to provide a relatively longer exercise stroke.
Figure 12:
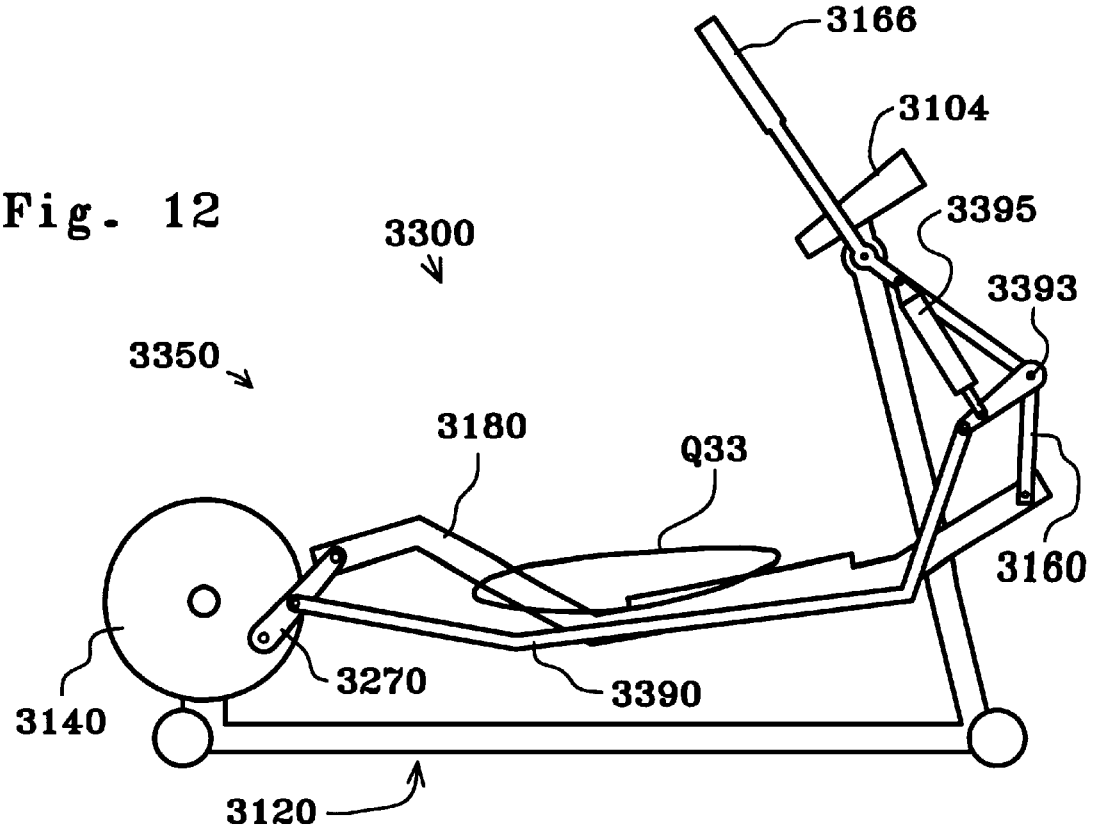
FIG. 12 is a side view of the exercise apparatus of FIG. 11, with the linkage assembly approximately one hundred and eighty degrees out of phase relative to the exercise apparatus of FIG. 11.

When the apparatus 3300 is configured as shown in FIGS. 9–10, rotation of the flywheels 3160 causes the foot platforms 3188 to move through elliptical paths designated as P33. When the apparatus 3300 is configured as shown in FIGS. 11–12, rotation of the flywheels 3160 causes the foot platforms 3188 to move through elliptical paths designated as Q33. As on the previous embodiments 3100 and 3200, the horizontal displacement of the foot platforms 3188 is controlled or limited by the pivot range of the axis D33 about the pivot axis C33. Adjustments to the pivot range are effected by selectively pivoting the levers 3393 relative to respective rocker links 3360. The actuators 3395 operate to pivot the levers 3393 in response to a control signal from the interface 3104. Such a control signal may be generated by a computer program and/or by direct user input. In the alternative, manually operated actuators could be adjusted by means of pins that lock respective telescoping members in place relative to one another.

On any of the foregoing embodiments, the inclination of the exercise paths may be adjusted in a variety of known ways. For example, the pivot axis (C31, C32, or C33) may be disposed on a frame member which is adjustable along the forward stanchion 3124, or a powered actuator, such as a motor or a hydraulic drive, may be disposed between the base 3122 and the underlying floor surface.

The foregoing embodiments may also be modified by the addition and/or substitution of various known inertia altering devices, including, for example, a motor, a "stepped up" flywheel, or an adjustable brake of some sort. Moreover, although many of the rotationally interconnected components are shown to be cantilevered relative to one another, many such components may be modified so that an end of a first component nests between opposing prongs on the end of a second component. Those skilled in the art will also recognize that each of the components of the linkage assemblies must be long enough to facilitate the depicted interconnections, and that for ease of reference in both this detailed description and the claims set forth below, linkage components are sometimes described with reference to "ends" being connected to other parts. However, those skilled in the art will further recognize that the present invention is not limited to links which terminate immediately beyond their points of connection with other parts. In other words, the term "end" should be interpreted to include "outside an intermediate portion", for example. Those skilled in the art will also recognize that the above-described components of the linkage assemblies may be arranged in a variety of ways.

The present invention may be described in terms of methods, as well. For example, the present invention provides a method of linking rotation of left and right cranks to generally elliptical motion of left and right foot supporting members, comprising the steps of: providing a frame sized and configured to support a person relative to an underlying floor surface; rotatably mounting the left and right cranks on the frame; pivotally mounting left and right rocker links on the frame; movably interconnecting left and right foot supporting linkages between respective rocker links and respective cranks; and movably mounting left and right drawbar linkages between respective rocker links and respective cranks, such that pivoting of the rocker links determines horizontal displacement of the foot supports.

Recognizing that the foregoing description and accompanying figures set forth only some of the numerous possible embodiments and variations of the present invention, and that other modifications and/or variations are likely to be recognized by those skilled in the art, the scope of the present invention is to be limited only to the extent of the claims which follow.

What is claimed is:

1. An exercise apparatus, comprising:

a frame sized and configured to occupy a fixed position relative to a support surface;

a left crank and a right crank, wherein each said crank is mounted on a respective side of said frame and rotatable about a common crank axis;

a left rocker link and a right rocker link, wherein each said rocker link is mounted on a respective side of said frame and rotatable about a common pivot axis;

a left foot supporting linkage and a right foot supporting linkage, wherein each said foot supporting linkage is movably connected between a respective rocker link and a respective crank; and a left drawbar linkage and a right drawbar linkage, wherein each said drawbar linkage is movably connected between a respective rocker link and a respective crank in such a manner that a foot supporting portion of each said foot supporting linkage is constrained to move through a generally elliptical path as a respective crank rotates, and each said drawbar linkage is selectively movable relative to a respective rocker link to alter a respective path.

2. The exercise apparatus of claim 1, wherein each said foot supporting linkage includes a foot supporting member and a crank link rotatably connected between the foot supporting member and a respective crank.

3. The exercise apparatus of claim 2, wherein each said drawbar linkage includes a first link and a second link which are rotatably connected to one another, and an opposite end of each said first link is rotatably connected to a respective crank link, and an opposite end of each said second link is rotatably connected to a respective rocker link.

4. The exercise apparatus of claim 3, wherein each said first link and a respective second link define an axis of rotation which is constrained to move through a reciprocal path relative to a respective foot supporting member.

5. The exercise apparatus of claim 4, wherein each said reciprocal path is defined by a linear slot formed in a respective foot supporting member.

6. The exercise apparatus of claim 3, further comprising a left actuator and a right actuator, wherein each said actuator is interconnected between a respective second link and a respective rocker link.

7. The exercise apparatus of claim 2, wherein each said foot supporting member is rotatably connected to a distal end of a respective crank link, and each said drawbar linkage includes a first link and a second link which are rotatably connected to one another, and an opposite end of each said first link is rotatably connected to an intermediate portion of a respective crank link, and an opposite end of each said second link is rotatably connected to a respective rocker link.

8. The exercise apparatus of claim 2, wherein a portion of each said drawbar linkage rotates about said common crank axis.

9. The exercise apparatus of claim 1, wherein each said drawbar linkage includes a member which is selectively movable along a respective rocker link.

10. The exercise apparatus of claim 1, wherein each said drawbar linkage includes a member which is selectively rotatable relative to a respective rocker link.

11. An exercise apparatus, comprising:

a frame sized and configured to occupy a fixed position relative to a support surface;

a left crank and a right crank, wherein each said crank is mounted on a respective side of said frame and rotatable about a common crank axis;

a left rocker link and a right rocker link, wherein each said rocker link is mounted on a respective side of said frame and rotatable about a common pivot axis;

a left foot supporting means and a right foot supporting means, each said foot supporting means movably connected between a respective rocker link and a respective crank, for supporting a person's feet;

a left constraining means and a right constraining means, each said constraining means movably connected between a respective rocker link and a respective crank, for constraining the person's feet to move through a generally elliptical path as a respective crank rotates; and a left adjusting means and a right adjusting means, each said adjusting means interconnected between a respective constraining means and a respective rocker link, for adjusting each said constraining means relative to a respective rocker link and thereby altering a respective elliptical path.

12. The exercise apparatus of claim 11, wherein each said foot supporting means includes a foot supporting member and a crank link rotatably connected between the foot supporting member and a respective crank.

13. The exercise apparatus of claim 12, wherein each said constraining means includes a first link and a second link which are rotatably connected to one another, and an opposite end of each said first link is rotatably connected to a respective crank link, and an opposite end of each said second link is rotatably connected to a respective rocker link.

14. The exercise apparatus of claim 13, wherein each said first link and a respective second link define an axis of rotation which is constrained to move through a reciprocal path relative to a respective foot supporting member.

15. The exercise apparatus of claim 14, wherein each said reciprocal path is defined by a linear slot formed in a respective foot supporting member.

16. The exercise apparatus of claim 13, wherein each said adjusting means includes an actuator interconnected between a respective second link and a respective rocker link.

17. The exercise apparatus of claim 12, wherein each said foot supporting member is rotatably connected to a distal end of a respective crank link, and each said constraining means includes a first link and a second link which are rotatably connected to one another, and an opposite end of each said first link is rotatably connected to an intermediate portion of a respective crank link, and an opposite end of each said second link is rotatably connected to a respective rocker link.

18. The exercise apparatus of claim 12, wherein a portion of each said constraining means rotates about said common crank axis.

19. The exercise apparatus of claim 11, wherein each said constraining means includes a member which is selectively movable along a respective rocker link.

20. The exercise apparatus of claim 11, wherein each said constraining means includes a member which is selectively rotatable relative to a respective rocker link.

21. An exercise apparatus, comprising:

a frame designed to occupy a fixed position relative to a floor surface;

a left crank and a right crank, wherein each said crank is mounted on a respective side of said frame and rotatable relative thereto about a common crank axis;

a left crank link and a right crank link, wherein each said crank link is mounted on a respective crank and pivotal relative thereto about a respective rotating axis;

a left rocker link and a right rocker link, wherein each said rocker link is mounted on a respective side of said frame and pivotal relative thereto about a common pivot axis;

a left foot support and a right foot support, wherein each foot support has a first portion connected to a respective crank link, a second portion connected to a respective rocker link, and a third portion sized and configured to support a person's foot; and a left drawbar and a right drawbar, wherein each said drawbar has a first portion pivotally connected to one of a respective crank and a respective crank link, and a second portion connected to at least one of a respective foot support and a respective rocker link.

* * * * *